United States Patent [19]

Mines et al.

[11] 3,980,847

[45] Sept. 14, 1976

[54] PIGGY BACK ELECTRIC FLOAT SWITCH

[76] Inventors: Kenneth S. Mines, 516 NW. 179th St., Miami, Fla. 33169; Irving Mines, 400 Kings Point Drive, No. 610; Guy Goulet, 400 Kings Point Drive, both of N. Miami Beach, Fla. 33160

[22] Filed: Nov. 13, 1974

[21] Appl. No.: 523,197

[52] U.S. Cl. ..... 200/84 B

[51] Int. Cl.[2] ..... H01H 35/18

[58] Field of Search ..... 200/84 B

[56] References Cited

UNITED STATES PATENTS

| | | | |
|---|---|---|---|
| 2,270,784 | 1/1942 | Miller et al. | 200/84 B |
| 2,816,973 | 12/1957 | Beck et al. | 200/84 B |
| 3,309,687 | 4/1967 | Phipps | 200/84 B |
| 3,515,830 | 6/1970 | Johnson | 200/84 B |
| 3,592,981 | 7/1971 | Ryle | 200/84 B |

*Primary Examiner*—David Smith, Jr.
*Attorney, Agent, or Firm*—Arthur A. Jacobs

[57] ABSTRACT

A switch means for closing an electrical circuit to operate any desired device such as a pump or an alarm, the switch means being adapted to be positioned in the bilge of a ship or boat and being actuated into circuit closing position by the rising of the bilge water beyond a predetermined level, the switch means including a float riding on the water and wires which are always clear of the water and are not subject to bending or frictional stresses and strains.

3 Claims, 6 Drawing Figures

FIG. 1
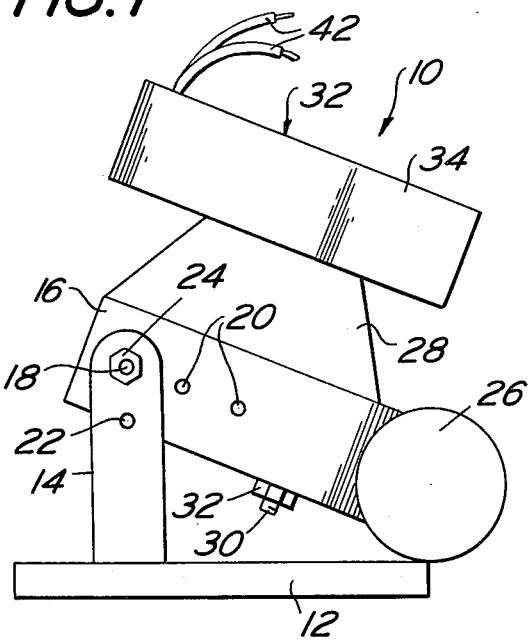
FIG. 2
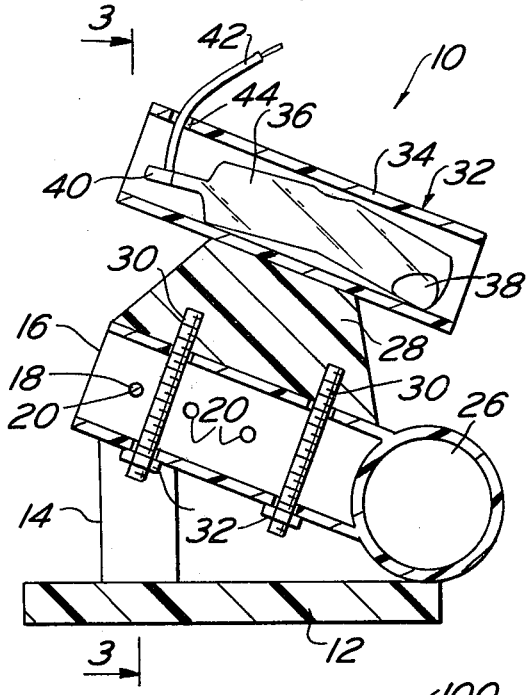
FIG. 5
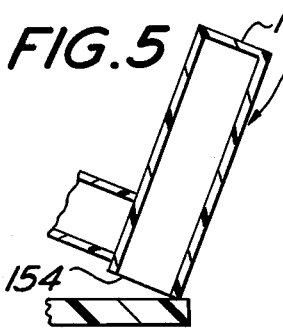
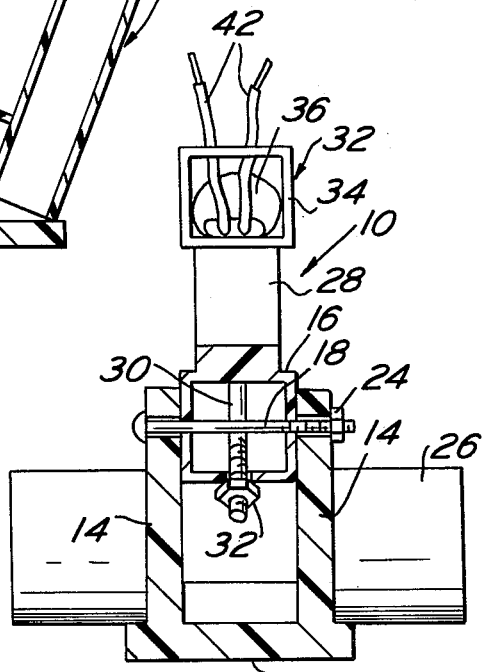
FIG. 3
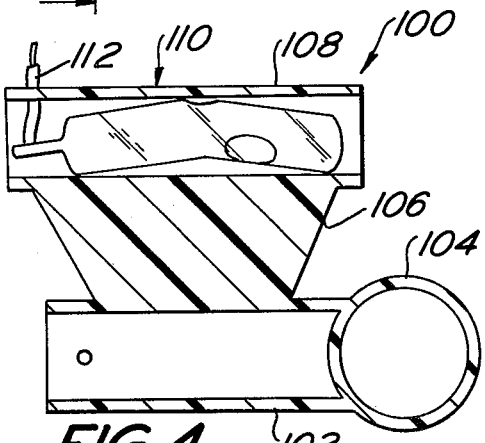
FIG. 4
FIG. 6
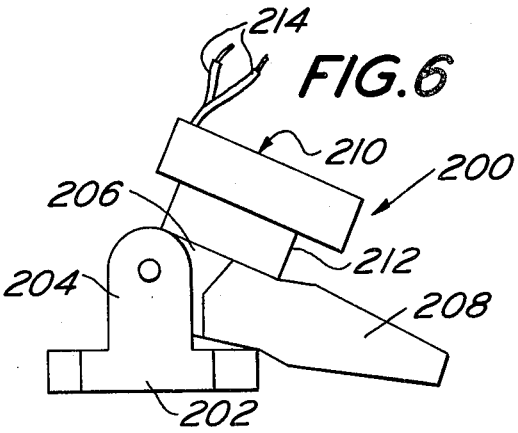

PIGGY BACK ELECTRIC FLOAT SWITCH

This invention relates to a switch means, and it particularly relates to a switch means adapted to be mounted on a boat or ship for the purpose of actuating a device in accordance with rising water in the bilge of the ship.

The water in the bilge of a ship should be maintained below a maximum level which is considered safe. However, since the bilge is not usually under direct observation, it is necessary to provide an automatic device to sound an alarm or to actuate a pump or the like when the water reaches such maximum level. This is accomplished by the provision of an electrical switch which is closed by the water in the bilge when such water reaches a predetermined level. The switch may be used to close an electrical circuit which actuates an alarm such as a horn or lamp, operates a pump to pump out the water until it falls below the predetermined level, or operates any other desired device.

There have been various problems connected with prior switch means of the aforesaid type. One of these problems relates to the fact that the electrical wires leading from the switch were constantly in contact with the bilge water, resulting in rapid corrosion of the wires. Another problem related to the fact that the electrical wires constantly moved and bent with the movement of the switch float, thereby resulting in wear and tear of the wires and in frictional sticking of the float in the "on position". Another disadvantage of most of the prior type switch means was the fact that they were formed in integral molded units wherein the switch was so encased that if it became defective it could not be repaired or replaced without destroying the entire device. Furthermore, these prior switch means were incapable of adjustment to various conditions such as different required leverages for larger or smaller bodies of bilge water.

It is, therefore, one object of the present invention to provide a switch means actuatable by rising bilge water which has a switch device in a so-called "piggy-back" position wherein it is positioned above the water so that the electrical wires leading therefrom are not normally in contact with the water.

Another object of the present invention is to provide a switch means of the aforesaid type wherein the electrical wires are not subject to the stresses and strains of constant bending and frictional contact during movement of the switch body.

Another object of the present invention is to provide a switch means of the aforesaid type where the parts may be made separable to permit repair and replacement of parts.

Another object of the present invention is to provide a switch means of the aforesaid type which is adjustable in accordance with the conditions of use.

Other objects and many of the attendant advantages of this invention will be readily appreciated as the same becomes better understood by reference to the following description when read in conjunction with the accompanying drawings wherein:

FIG. 1 is a side elevational view of a switch means embodying the present invention.

FIG. 2 is a sectional view of the device of FIG. 1.

FIG. 3 is a sectional view taken on line 3—3 of FIG. 2.

FIG. 4 is a side sectional view of a modified form of the invention.

FIG. 5 is a side elevational view of another form of the invention.

FIG. 6 is a fragmentary sectional view of still another form of the invention.

Referring now in greater detail to the figures of the drawings wherein similar reference characters refer to similar parts, there is shown a switch means, generally designated 10, comprising a base 12 having a pair of vertical standards 14 between which is pivotally positioned a shaft 16 of generally square cross-section. Although the shaft 16 is shown as being hollow, it may be made solid within the scope of the invention. The shaft 16 is pivotally connected to the standards 14 by a pivot pin, bolt, or the like 18 extending through one of a series of apertures 20 in the shaft and through one of a series of corresponding apertures 22 in the standards 14. The bolt 18 is held in place by a nut 24. Instead of a bolt and nut, a pin or any other desired pivot means may be used.

The series of apertures 20 permit the pivot connection of the shaft 16 to be adjustable to vary the effective length and, therefore, the throw or leverage of the shaft. The pivot point may also be adjusted vertically relative to the standards 14 by means of the series of apertures 22 in the standards.

At that end of the shaft which is remote from the pivot is provided a float 26 constituted by a tubular body closed at both ends.

Although not shown, it is within the scope of the present invention to provide a stop, of any desired construction, on either base 14 or shaft 16 to prevent the float from rising too high and sticking.

Mounted on the shaft 16 is a support 28, this support being held in place by a pair of bolts 30 extending through corresponding apertures in the shaft 16 and in the bottom of the support. Nuts 32 hold the bolts in position.

Mounted on the support 28 is a mercury switch device 32 which comprises a housing 34, closed at its ends. In the housing 34 is a tube 36 that is bent at its median portion and contains a ball of mercury 38. The use of a housing 34 and a separate tube 36 is described as one form of the switch construction. It is also possible to mold or otherwise construct the housing 34 so that it, itself, acts as the mercury switch means thereby eliminating the use of a separate tube.

The housing 34 may be connected to the support 28 in any desired manner such as by nuts and bolts, screws, adhesive or the like. In any event, the housing is preferably made separable from the support 28 to facilitate replacement, although even if it is not made separable, replacement can still be effected by replacing both the support 28 and the mercury device 32 as a unit. The mercury tube 36 is provided with leads 40 to which are connected the wires 42 in the ordinary manner. However, these wires extend upwardly through apertures 44 in the top of the housing 34 so that they always remain clear of the water in the bilge.

Although a mercury switch is disclosed, it is also within the scope of the invention to substitute any other feasible type of electrical switch, such as one using a ball bearing, oil, water, etc. Furthermore, instead of a pyramid-shaped support such as shown at 28, it is within the scope of the invention to provide any other type of connection means to connect the housing 34 to the shaft 16, such as one or more bolts, studs, or the like.

In operation, the base 12 is attached to the supporting surface of the bilge area and the float 26 rests on the surface of the water. If the water rises beyond a predetermined level, it acts to raise the float to the position where the mercury switch is inclined in the opposite direction from that shown. This causes the mercury to engage the contacts 40 to close the circuit through the wires 42. However, in either position, the wires 42 are always far above the level of the water so there is no contact therewith. Furthermore, during any pivotal movement there is no frictional contact between the wires and any other moving part, nor are the wires bent around any other part. The wires are, therefore, free from both corrosion by the water and stresses and strains caused by the pivotal action of the switch means.

In FIG. 4 there is illustrated a modified form of switch means, generally designated 100, wherein the parts are essentially the same as the device shown in FIGS. 1, 2 and 3, including the same type of base and standards (not shown). However, in this form of the invention, the shaft 102, to which the float 104 is connected, is made integral with the support 106, which, in turn, is made integral with the housing 108 of the switch device 110. This construction does not permit dissassembly of the parts for repairs or replacement but is less expensive in that it can be molded as a unit, thereby cutting down on material and labor costs. But this construction, too, keeps the wires 112 clear of the water and does not subject them to frictional or bending stresses and strains.

In FIG. 5 there is shown a modified form of float means which may be substituted for the float shown in FIGS. 1–4. This float, designated 150, comprises a vertical tube or cylinder which is closed at the upper end 152 but is open at the lower end 154. The cylinder is sufficiently long so that although the bottom end is immersed in the water, the water only rises to a low level (usually about ¼ inch) and remains there. The water, therefore, not only acts to trap the air in the upper portion of the cylinder to cause it to float, but also acts as a seal for the bottom end of the float.

In FIG. 6 there is shown another modification, generally designated 200, which comprises a base 202 and standards 204 between which is pivoted a stem 206 of a float 208. The float 208 is constructed as an integral housing instead of comprising a shaft and transverse tubular float as in the devices of FIGS. 1–4. This construction is not quite as effective as the transverse tube type of float which has a greater area in contact with the water and is, therefore, more sensitive to small fluctuations of water level, but it is less expensive to make since it requires only a relatively simple molding operation. However, here, too, the switch device 210 is mounted above the float on a support 212 and the wires 214 are clear of the water and not subject to bending and frictional stresses and strains.

The invention claimed is:

1. An electrical switch means operable by the rising and falling level of a body of water, comprising a base, standards mounted on said base and extending upwardly therefrom, a shaft having at least one transverse aperture therethrough, said aperture being positioned adjacent one end of said shaft, a pivot pin extending through said standards and through said transverse aperture in said shaft to form a pivotal connection between said shaft and said standards, a float mounted at the end of said shaft opposite the end to which said aperture is adjacent, a support mounted on said shaft and extending upwardly therefrom, said support having an upper surface which is positioned in vertically spaced relation to the upper plane of said float, an elongated mercury switch housing mounted on said upper surface of said support, said switch housing being substantially parallel to said shaft, said switch housing containing a mercury switch comprising a ball of mercury in a tube, said tube extending generally parallel to said shaft but being bent at its median portion to form opposed downwardly-inclined sections, said tube having leads at one end to which are connected electrical wires for connection to a device to be electrically actuated and deactuated by movement of said mercury switch, said wires extending laterally from said tube through a lateral opening in said switch housing, said lateral opening being on the side of said housing remote from said support, said mercury switch being movable from an actuating to a deactuating position by pivotal movement of said shaft resulting from rising and falling of said float as said float rests on said body of water.

2. The switch means of claim 1 wherein said float is a closed, elongated, hollow body mounted at one end of said shaft with the axis of said body being transverse to the axis of said shaft and generally parallel to the axis of said pivotal connection.

3. The switch means of claim 1 wherein said float is an elongated hollow body mounted at one end of said shaft with the axis of said body being transverse to both the axis of said shaft and the axis of said pivotal connection, said body having one end constructed and arranged to be in contact with a body of water, said one end being open and the opposite end being closed.

* * * * *